US008281759B2

(12) United States Patent
Evans et al.

(10) Patent No.: US 8,281,759 B2
(45) Date of Patent: Oct. 9, 2012

(54) ANTI-ROTATION LOCKING MECHANISM FOR CONTROLLING MECHANICAL PLAY

(75) Inventors: Matt Evans, Warren, MI (US); Tracy Novinski, Macomb Township, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 465 days.

(21) Appl. No.: 12/668,348

(22) PCT Filed: Jun. 20, 2008

(86) PCT No.: PCT/EP2008/057893

§ 371 (c)(1),
(2), (4) Date: Jan. 8, 2010

(87) PCT Pub. No.: WO2009/007225

PCT Pub. Date: Jan. 15, 2009

(65) Prior Publication Data

US 2010/0175643 A1 Jul. 15, 2010

Related U.S. Application Data

(60) Provisional application No. 60/948,630, filed on Jul. 9, 2007.

(51) Int. Cl.
*F01L 1/14* (2006.01)

(52) U.S. Cl. ..... 123/90.5; 123/90.52; 123/90.55

(58) Field of Classification Search ..... 123/90.5, 123/90.52, 90.55, 90.43, 90.16
See application file for complete search history.

(56) References Cited

U.S. PATENT DOCUMENTS

| | | | | |
|---|---|---|---|---|
| 3,108,580 | A | 10/1963 | Crane, Jr. | |
| 3,886,808 | A | 6/1975 | Weber | |
| 4,089,234 | A | 5/1978 | Henson et al. | |
| 5,022,356 | A * | 6/1991 | Morel et al. | 123/90.5 |

FOREIGN PATENT DOCUMENTS

| | | | |
|---|---|---|---|
| DE | 43 24 756 | A | 2/1995 |
| DE | 103 32 981 | A | 2/2005 |
| WO | 03/008771 | A | 1/2003 |
| WO | 03/067038 | A | 8/2003 |

* cited by examiner

*Primary Examiner* — Zelalem Eshete
(74) *Attorney, Agent, or Firm* — Lucas & Mercanti, LLP; Klaus P. Stoffel

(57) ABSTRACT

The antirotational, mechanical lash control mechanism for two reciprocating bodies having opposing cylindrical surfaces uses a radial U-shaped groove in the outer surface of the outer housing; a radial cut in the leg of said U-shaped groove, that extends from the groove into said bore; a U-shaped clip adapted to fit the U-shaped groove, the U-shaped clip having a ledge on a leg of U-shaped clip, where the ledge extends through said cut and into said bore; and a first stop on the outer surface of the inner housing, such that the first stop abuts said ledge to control mechanical lash between the outer housing and the inner housing. To prevent rotation, the ledge has a flat surface that mates to a flat surface on the inner housing.

12 Claims, 6 Drawing Sheets

ANTI-ROTATION LOCKING MECHANISM FOR CONTROLLING MECHANICAL PLAY

This application is a 371 of PCT/EP2008/057893 filed Jun. 20, 2008, which in turn claims the priority of U.S. 60/948,630 filed Jul. 9, 2007, the priority of both applications is hereby claimed and both applications are incorporated by reference herein.

FIELD OF THE INVENTION

This Invention relates to controlling mechanical lash and preventing rotation between two reciprocating members and, more particularly, to valve train components used in internal combustion engines having an elongated outer housing with a bore therein and a cylindrical inner housing where the inner housing moves in the bore in a reciprocating manner with respect to the outer housing.

BACKGROUND OF THE INVENTION

Valve train components, such as switchable hydraulic pivot elements, switchable roller lifters and valve lifters, typically comprise an outer housing with a bore therein that houses an inner cylindrical body which moves reciprocally in the bore. The bore and the inner housing are concentric and the surface of the bore and the outer surface of the inner housing have opposing cylindrical surfaces which are coaxial to one another.

In order to prevent rotational movement between the two opposing cylindrical surfaces, anti-rotational mechanisms, such as a channel and a pin, are often used. The channel is cut or formed axially in one of the opposing cylindrical surfaces and a pin is radially fixed in the other opposing cylindrical surface. The pin extends radially into the channel and, thereby, prevents rotational movement between the two cylindrical surfaces. The channel can be closed at one or both ends such that the closed end of the channel acts as a stop to control lash between the outer and inner housings.

It can be difficult to form the channel-pin arrangement in the opposing cylindrical surfaces. The groove has to be cut in one of the opposing cylindrical surfaces, a hole has to be drilled in the other of the opposing cylindrical surfaces, and the pin inserted in the hole. Depending on the size of the two cylindrical members, this can be a rather complicated process.

In switchable valve train components, mechanical lash is generally defined as the axial play or clearance between the locking mechanism of the inner housing and an engageable feature on the outer housing during the locked mode. Control of mechanical lash is achieved by altering the axial height of the locking mechanism contained within the inner housing with respect to the engageable locking surface of the outer housing.

It is important to control mechanical lash to a specified range and avoid excessive play or movement between the inner and outer housings. The camshaft that actuates a switchable component is designed to accommodate the prescribed mechanical lash. If the mechanical lash falls outside of the design parameters of the camshaft, the potential for accelerated locking mechanism wear is increased. In this state, the dynamic performance of the valve train may be compromised. A controlled mechanical lash between the housings provides for a more durable switchable valve train component as well as the other components of the valve train.

OBJECT OF THE INVENTION

It is the object of this Invention to provide an inexpensive and simple mechanism for controlling lash and for preventing rotation between two opposing cylindrical surfaces of reciprocating members.

These and other objects and advantages of the Invention become clearer from the following description.

SUMMARY OF THE INVENTION

The Invention achieves the above objects by using a radial U-shaped groove in the outer surface of the outer housing, a radial cut in at least one of the legs of the U-shaped groove wherein the cut extends from the groove into the bore of the outer housing, a stop and/or axial indentation on the outer surface of the inner cylindrical housing and a U-shaped clip adapted to fit the U-shaped groove, wherein the clip has a ledge on one leg that extends through the cut and into the bore.

To control mechanical lash, the thickness of the U-shape clip is categorized to control the axial position of the inner housing assembly stop or stops. The number of inner housing assembly stops may be one or two depending on the number of axial indentations, as shown in FIGS. 6 and 5, respectively. This, in turn, changes the axial position of the inner housing locking mechanism with respect to the engageable locking surface of the outer housing.

Using two axially spaced stops, one stop is referred to as an assembly stop and the other stop is referred to as a mis-switch stop. It is the interaction between the assembly stop and the U-shaped clip that controls the lash. The appropriate thickness of the U-shaped clip is selected to achieve a mechanical lash within the specification of the given component.

To prevent rotation of the inner housing in the bore, the axial indentation has a flat axial surface and the ledge has a flat axial surface that matches the flat axial surface of the indentation so as to prevent rotation of the inner housing.

This arrangement of the cut, stop, ledge and indentation can be provided on more than one side of the housings, preferably, this arrangement is on two sides such that they mirror each other.

Broadly, the lash control mechanism device of the present Invention can be defined as comprising:

(a) an elongated outer housing having an outer surface and a cylindrical bore therein;

(b) a cylindrical inner housing positioned in said bore for reciprocal movement therein, said inner housing having an outer cylindrical surface;

(c) a radial U-shaped groove in the outer surface of the outer housing, said U-shaped groove having a first and second leg;

(d) a first radial cut in the first leg of said U-shaped groove, said cut extending from said groove into said bore;

(e) a U-shaped clip adapted to fit said U-shaped groove, said U-shaped clip having a first and second leg;

(f) a first ledge on said first leg of said U-shaped clip, said ledge extending through said first cut and into said bore; and (g) a first stop on said outer surface of said inner housing, such that said first stop abuts said first ledge to control mechanical lash between the outer housing and the inner housing.

Preferably, there is a second radial cut in the second leg of said U-shaped groove, said second cut extending from said groove into said bore; a second ledge on the second leg of said U-shaped clip, said second ledge extending through said second cut and into said bore; and a second stop on said outer surface of said inner cylindrical body which abuts said second ledge such that the first stop and second stop and first ledge and second ledge interact to control mechanical lash.

Preferably, there is a third stop positioned axially apart from said first stop on the outer surface of said inner housing and the first ledge of said U-shaped clip is positioned axially between the first and third stop. The third stop acts as a mis-switch stop to prevent excessive telescoping of the inner housing within the outer housing.

More preferably, there is a fourth stop positioned axially apart from said second stop on the outer surface of the inner housing and the second ledge of said U-shaped clip is positioned axially between the second and the fourth stop. The fourth stop acts as a mis-switch stop to prevent excessive telescoping of the inner housing within the outer housing.

In order to prevent rotational movement between the bore and the inner housing the mechanism of the present Invention can be defined as comprising:

(a) an elongated outer housing having an outer surface and a cylindrical bore therein;
(b) a cylindrical inner housing positioned in said bore for reciprocal movement therein, said inner housing having an outer cylindrical surface;
(c) a radial U-shaped groove in the outer surface of the outer housing, said U-shaped groove having a first and second leg;
(d) a first radial cut in the first leg of said U-shaped groove, said cut extending from said groove into said bore;
(e) a U-shaped clip adapted to fit said U-shaped groove, said U-shaped clip having a first and second leg;
(f) a first ledge on said first leg of said U-shaped clip, said ledge extending through said first cut and into said bore, said first ledge having a flat axial surface; and
(g) a first axial indentation on said outer cylindrical surface of said inner housing, said first indentation having a flat axial surface that matches said flat axial surface of said first ledge to prevent rotation of the inner housing in the bore.

Preferably, there is a second radial cut in the second leg of said U-shaped groove, said second cut extending from said groove into said bore; a second ledge on the second leg of said U-shaped clip, said second ledge extending through said second cut and into said bore, the second ledge has a flat axial surface; and a second axial indentation on said outer surface of said inner housing, said second indentation having a flat axial surface that matches said flat axial surface of said second ledge such that the first indentation and the second indentation and first ledge and second ledge interact to prevent rotation of the inner housing in the bore.

Preferably, the antirotational mechanism and the lash control mechanism are combined. In such a combination, the first axial indentation extends axially from the first stop. More preferably, said second axial indentation extends axially from the second stop and forms a parallel flat surface to the surface of said first axial indentation. Even more preferably, the first and third stops are positioned at either axial end of the first indentation and the second and fourth stops are positioned at either axial end of the second indentation so as to provide lash control and prevent rotation of the inner housing in the bore.

BRIEF DESCRIPTION OF THE DRAWINGS

The Invention will now be described more closely with reference to the following drawings, wherein.

DETAILED DESCRIPTION OF THE INVENTION

Figure 1:
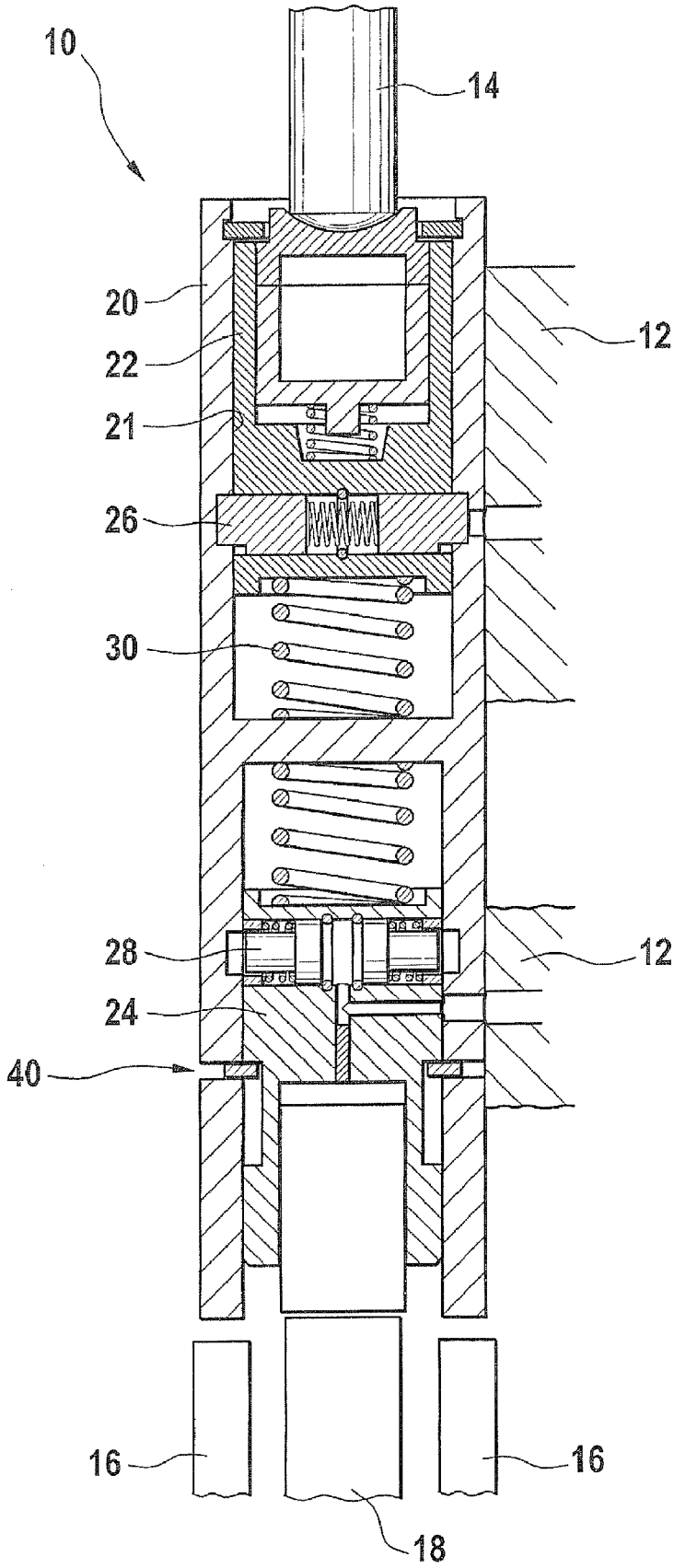
FIG. 1 illustrates the Invention in a three-phase valve lifter.

FIG. 1 illustrates valve lifter 10 slidably mounted in engine block 12. One end of valve lifter 10 is associated with push rod 14 while the other end of valve lifter 10 is associated with low lift cam 16 and high lift cam 18 which were each connected to a conventional cam shaft, not shown.

Valve lifter 10 comprises outer cam follower 20 which is an elongated outer housing having a cylindrical bore 21 therein. Slidably positioned within bore 21 of outer cam follower 20 are upper inner housing assembly 22 and lower inner cam follower 24. Upper locking means 26 is provided in upper inner housing assembly 22 and lower locking means 28 is provided in lower inner cam follower 24. Lost motion spring 30 is positioned between upper, inner housing assembly 22 and lower inner cam follower 24. Hydraulic oil is provided through engine block 12 to the locking means 26 and 28 to lock and unlock the inner cam followers 22 and 24 so as to allow for reciprocating movement between the outer cam follower 20 and inner housing assembly 22 and the inner cam followers 24. Antirotational lash control mechanism 40 is provided in lifter 10. Inner housing assembly 22 and inner cam follower 24 move reciprocally in bore 21.

Figure 2:
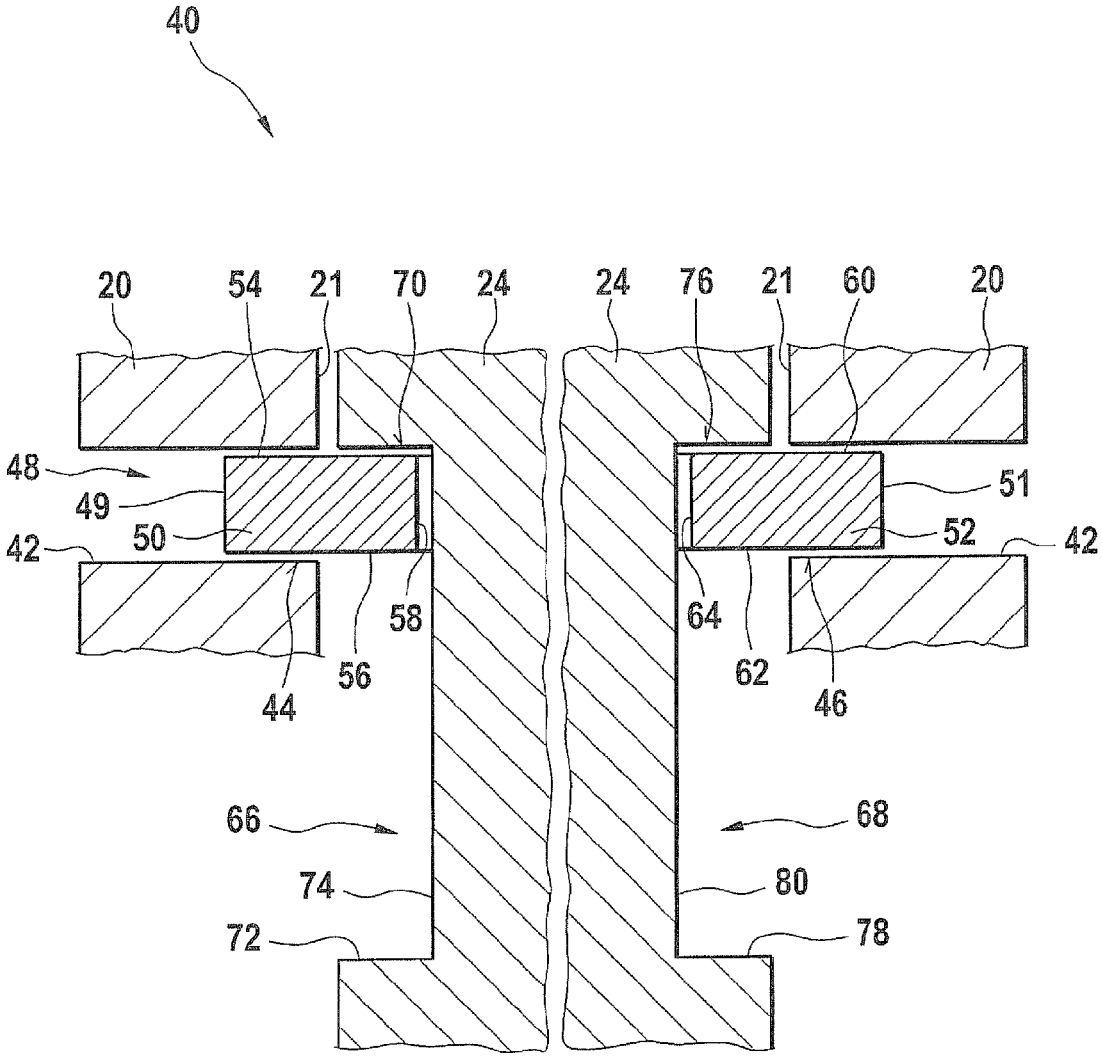
FIG. 2 is a detailed illustration of the antirotational and lash controlling mechanism as shown in FIG. 1.

As can be seen in more detail in FIG. 2, outer cam follower 20 has groove 42 formed in the outer surface of the follower 20 and first cut 44 and second cut 46. Cuts 42 and 46 extend from groove 42 into bore 21.

U-shaped clip 48 has first leg 49 with first ledge 50 and second leg 51 with second ledge 52. First ledge 50 has top surface 54, bottom surface 56 and flat axial surface 58. Second ledge 52 has top surface 60, bottom surface 62 and flat axial surface 64.

Inner cam follower 24 has first axial indentation 66 and second axial indentation 68. First axial indentation 66 has a top stop 70, a bottom stop 72 and a flat axial surface 74 which matches the flat axial surface 58.

Second axial indentation 68 has top stop 76, bottom stop 78 and flat axial surface 80 that matches flat axial surface 64.

Top surfaces 54 and 60 abut stops 70 and 76, respectively, to stop downward movement while bottom surfaces 56 and 62 abut bottom stops 72 and 78, respectively, to stop upward movement. In FIG. 2, stops 70, 76 act as assembly stops and stops 72 and 78 act as mis-switch stops. Lash is controlled by selecting U-shaped clip 48 with a thickness that achieves a mechanical lash that falls within the specified range for the given component.

Flat axial surfaces 58 and 64 match flat axial surfaces 74 and 80 to prevent rotational movement of inner cam follower 24 inside bore 21.

Figure 3:
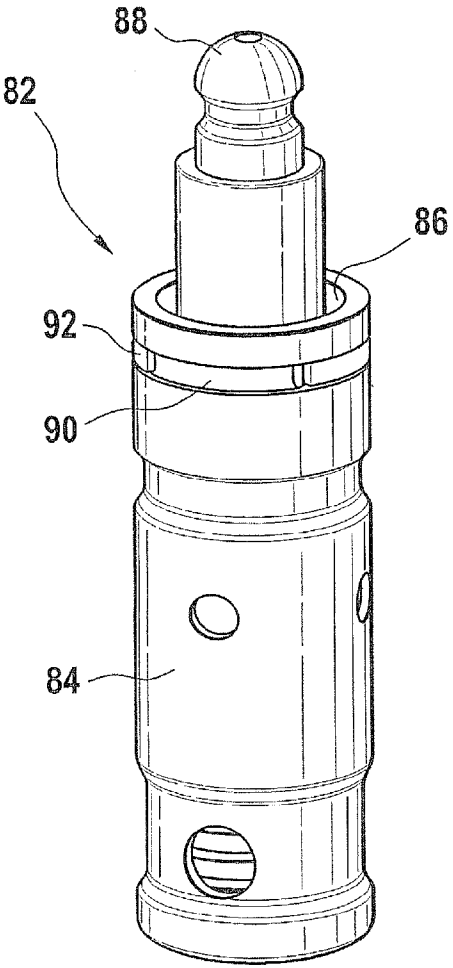
FIG. 3 illustrates a switchable hydraulic pivot element in accordance with the present Invention.

FIG. 3 shows switchable hydraulic pivot element 82 having cylindrical outer housing 84, a bore 86 therein and cylindrical inner housing 88 for movement reciprocally in bore 86.

U-shaped groove 90 is formed in the outer surface of cylindrical outer housing 84 and U-shaped clip 92 is positioned in U-shaped groove 90, as illustrated.

Figure 4:
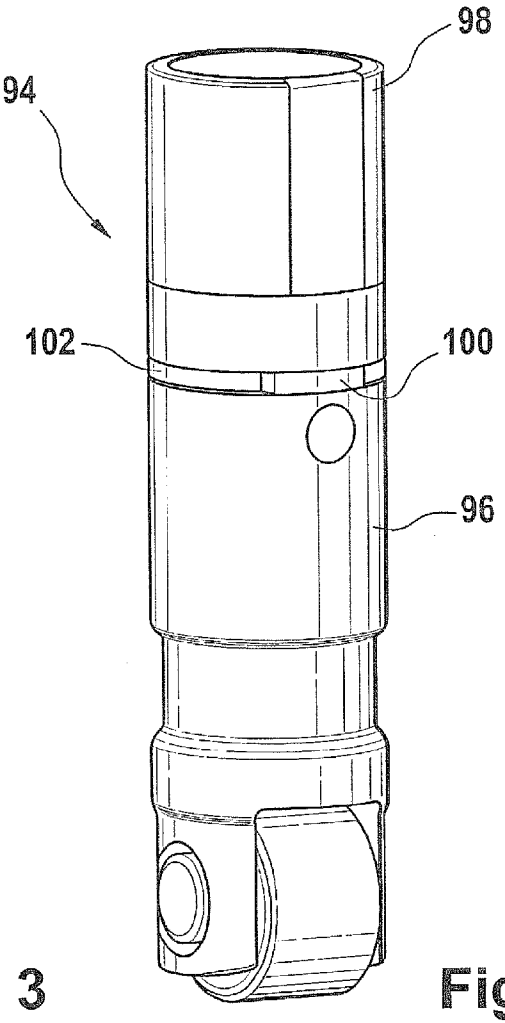
FIG. 4 illustrates a switchable roller lifter in accordance with the present Invention.

FIG. 4 illustrates switchable roller lifter 94 comprising outer housing 96 with inner bore 98. U-shaped groove 100 is illustrated with U-shaped clip 102 positioned therein.

Figure 5:
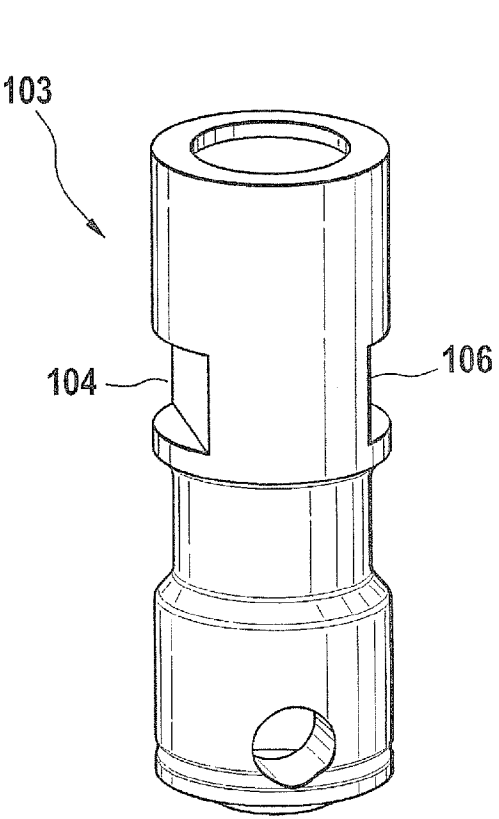
FIG. 5 illustrates the inner cylindrical housing having two indentations and four stops.

FIG. 5 illustrates a cylindrical inner housing 103 having both a first axial indentation 104 and a second axial indentation 106.

Figure 6:
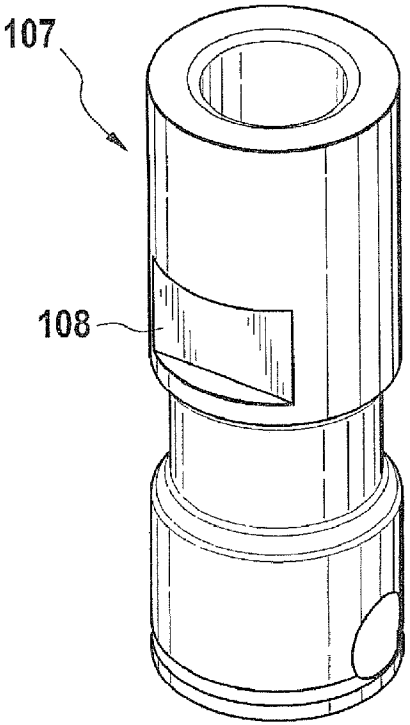
FIG. 6 illustrates an inner cylindrical housing with two stops and one indentation.

FIG. 6 illustrates a cylindrical inner housing 107 having only a first axial indentation 108.

Figure 7B:
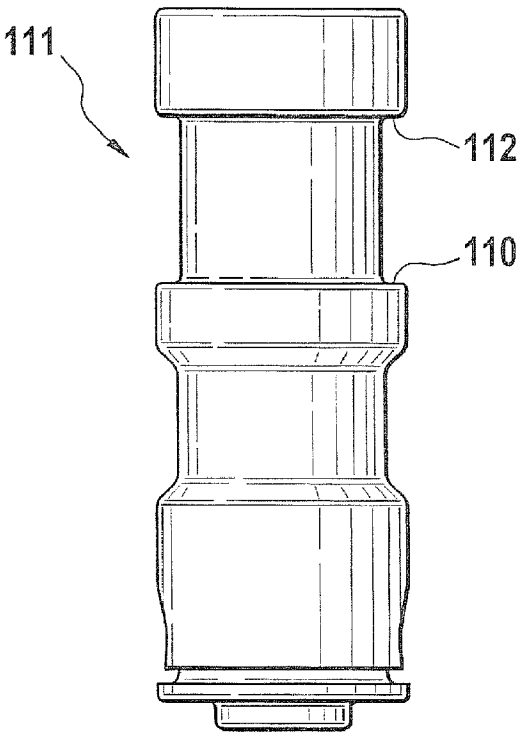
FIG. 7B illustrates an inner cylindrical housing with two stops and no indentation.
Figure 7A:
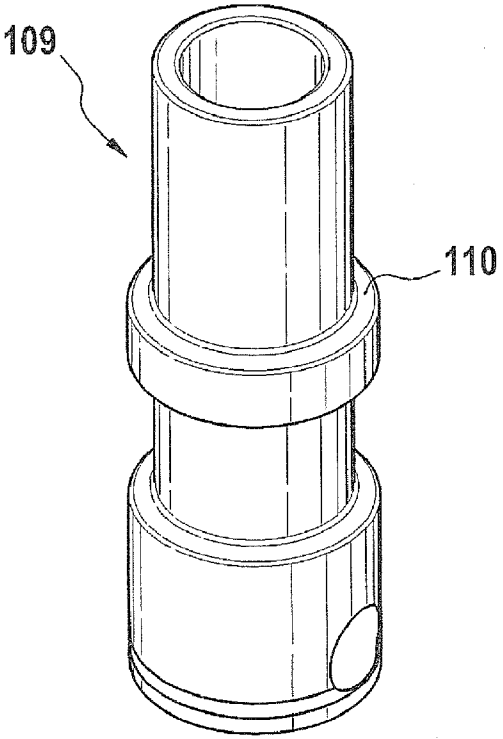
FIG. 7A illustrates an inner cylindrical housing with one stop and no indentation.

FIG. 7A illustrates a cylindrical inner housing 109 having only a bottom stop 110. Bottom stop 110 acts as an assembly stop.

FIG. 7B illustrates a cylindrical inner housing 111 having both bottom stop 110 and top stop 112. Top stop 112 acts as a mis-switch stop and bottom stop 110 acts as an assembly stop.

Figure 8:
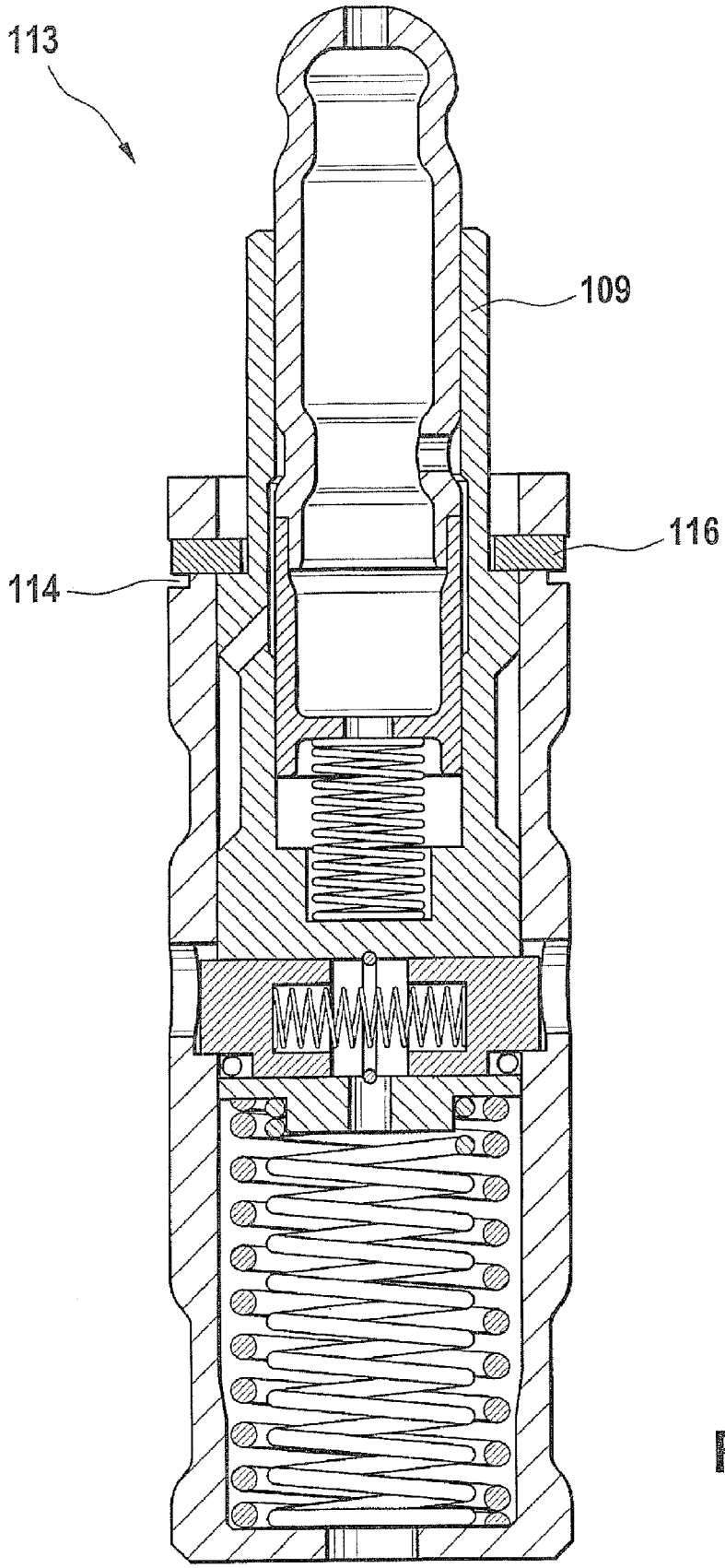
FIG. 8 illustrates a cross section of a switchable hydraulic pivot element having one stop and no indentation.

FIG. 8 illustrates a cross section of a switchable hydraulic pivot element 113 using the cylindrical inner housing 109 of FIG. 7A with U-shaped groove 114 and U-shaped clip 116. In switchable hydraulic element 113, lash is controlled by the thickness of clip 116 against bottom stop 110 (assembly stop).

FIGS. 9-12 illustrate both a top and a front view of the U-shaped clip 48 in accordance with the present Invention.

Figure 9:
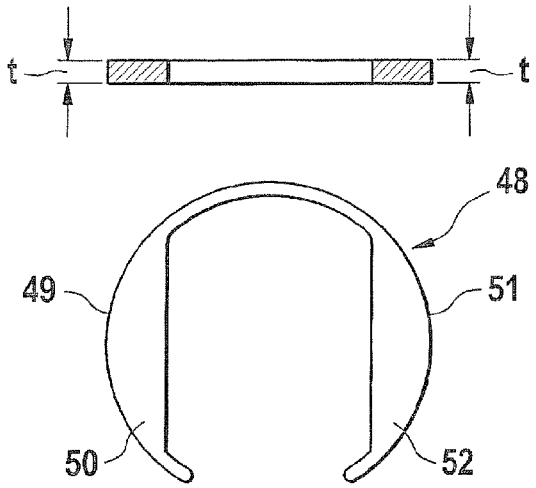
FIGS. 9-12 illustrate different embodiments of the U-shaped clip.

FIG. 9 shows a U-shaped clip of the present Invention with two opposing flat axial surfaces and thickness t.

Figure 10:
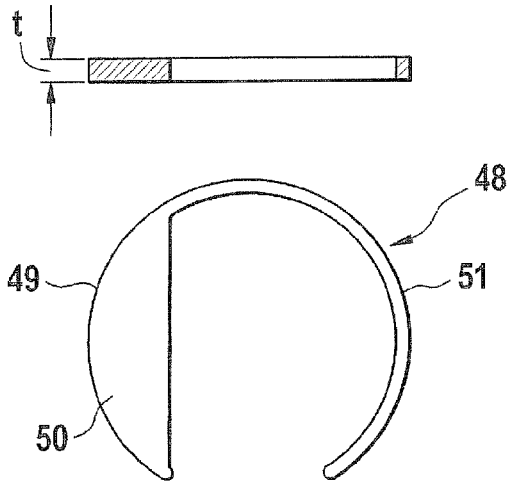

FIG. 10 illustrates the U-shaped clip with one flat axial surface.

Figure 11:
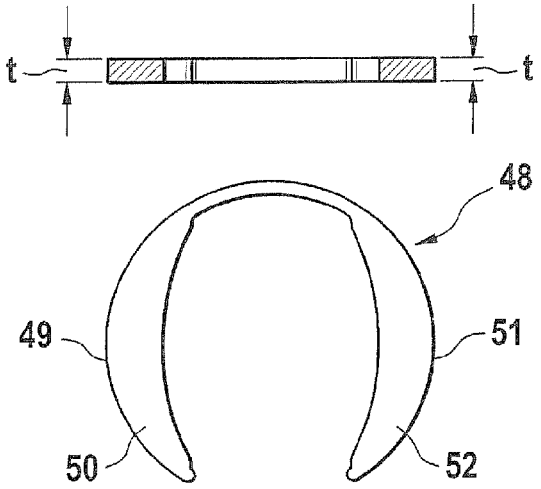

FIG. 11 illustrates the U-shaped clip having no flat axial surfaces, employed for controlling lash, only.

Figure 12:
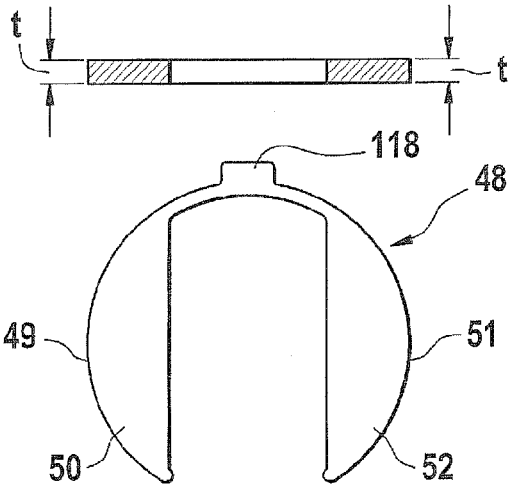

FIG. 12 illustrates the U-shaped clip employing two flat axial surfaces and a notch 118 for outer housing orientation control.

As will be appreciated, the ease of assembly and disassembly of the present Invention is self apparent. This is due to the exposed U-shaped clip that is easily removed from the U-shaped groove offering a simple means of disassembling the inner housing from the outer housing.

Furthermore, the present Invention provides superior packaging space because no additional component length is necessary in the present Invention.

Furthermore, forming the groove and making the cuts in the outer housing are simple compared to forming a groove inside the bore of the outer housing.

The U-shaped clip is made from sheet metal and has natural resistancy to maintain its U-shaped configuration thereby holding itself in the U-shaped groove.

Furthermore, the thickness t of the clip, as shown in FIG. 9, can be used to finely control lash. The thickness of the clip can be controlled by grinding the top and the bottom of the clip to achieve a uniform thickness. The clips are then sorted by thickness and either clips of different thicknesses or multiple clips can be used. Ultimately the maximum thickness of the U-shaped clip(s) will be dictated by the width of the groove.

Where two clips are used, one clip is necessary to hold the entire assembly together while a mechanical lash measurement is made. This measurement will determine the thickness of the clip necessary to achieve the required mechanical lash specification for the particular switchable component. After this measurement, the appropriate clip size is chosen and placed in the assembly.

REFERENCE CHARACTERS

10. Valve lifter
12. Engine block
14. Push rod
16. Low lift cam
18. High lift cam
20. Outer cam follower
21. Bore
22. Upper, inner housing assembly
24. Lower, inner cam follower
26. Upper locking means
28. Lower locking means
30. Lost motion spring
40. Locking mechanism
42. Groove
44. First cut
46. Second cut
48. U-shaped clip
49. First leg
50. First ledge
51. Second leg member U-shape
52. Second ledge
54. Top surface
56. Bottom surface
58. Flat axial surface
60. Top surface
62. Bottom surface
64. Flat Axial Surface
66. First axial indentation
68. Second axial indentation
70. Top stop
72. Bottom stop
74. Flat axial surface
76. Top stop
78. Bottom Stop
80. Flat axial surface
82. Switchable hydraulic pivot element
84. Outer cylindrical housing
86. Bore
88. Inner cylindrical
90. Groove
92. U-shaped clip
94. Switchable roller lifter
96. Outer housing
98. Bore
100. U-shaped groove
102. U-shaped clip
103. Inner housing
104. First axial indentation
106. Second axial indentation
107. Inner housing
108. First axial indentation
109. Inner housing
110. Bottom stop
111. Housing
112. Top stop
113. Hydraulic pivot element
114. U-shaped groove
116. U-shaped clip
118. Notch

What we claim is:

1. A mechanical lash control mechanism for two reciprocating bodies having opposing cylindrical surfaces, comprising:

(a) an elongated outer housing having an outer surface and a cylindrical bore therein;

(b) a cylindrical inner housing positioned in said bore for reciprocal movement therein, said inner housing having an outer cylindrical surface;

(c) a radial U-shaped groove in the outer surface of the outer housing, said U-shaped groove having a first and second leg;

(d) a first radial cut in the first leg of said U-shaped groove, said cut extending from said groove into said bore;

(e) a U-shaped clip adapted to fit said U-shaped groove, said U-shaped clip having a first and second leg;

(f) a first ledge on said first leg of said U-shaped clip, said ledge extending through said first cut and into said bore; and (g) a first stop on said outer surface of said inner housing, such that said first stop abuts said first ledge to control mechanical lash between the outer housing and the inner housing.

2. The lash control mechanism of claim 1 further comprising:

a second radial cut in the second leg of said U-shaped groove, said second cut extending from said groove into said bore; a second ledge on the second leg of said U-shaped clip, said second ledge extending through said second cut and into said bore; and a second stop on said outer surface of said inner cylindrical body which abuts said second ledge such that the first stop and second stop and first ledge and second ledge interact to control mechanical lash.

3. The lash control mechanism of claim 1, further comprising:

a third stop positioned axially apart from said first stop on the outer surface of said inner housing and the first ledge of said U-shaped clip is positioned axially between the first and third stop.

4. The lash control mechanism of claim 2, wherein a fourth stop positioned axially apart from said second stop on the outer surface of the inner housing and the second ledge of said U-shaped clip is positioned axially between the second and the fourth stop.

5. The lash control mechanism of claim 2, further comprising:

a third stop positioned axially apart from said first stop on the outer surface of said inner housing and the first ledge of said U-shaped clip is positioned axially between the first and third stop, and a fourth stop positioned axially apart from said second stop on the outer surface of the inner housing and the second ledge of said U-shaped clip is positioned axially between the second and the fourth stop.

6. An antirotational mechanism for reciprocating bodies having opposing cylindrical surfaces comprising:

(a) an elongated outer housing having an outer surface and a cylindrical bore therein;

(b) a cylindrical inner housing positioned in said bore for reciprocal movement therein, said inner housing having an outer cylindrical surface;

(c) a radial U-shaped groove in the outer surface of the outer housing, said U-shaped groove having a first and second leg;

(d) a first radial cut in the first leg of said U-shaped groove, said cut extending from said groove into said bore;

(e) a U-shaped clip adapted to fit said U-shaped groove, said U-shaped clip having a first and second leg;

(f) a first ledge on said first leg of said U-shaped clip, said ledge extending through said first cut and into said bore, said first ledge having a flat axial surface; and (g) a first axial indentation on said outer cylindrical surface of said inner housing, said first indentation having a flat axial surface that matches said flat axial surface of said first ledge to prevent rotation of the inner housing in the bore.

7. The antirotational mechanism of claim 6, further comprising:

a second radial cut in the second leg of said U-shaped groove, said second cut extending from said groove into said bore; a second ledge on the second leg of said U-shaped clip, said second ledge extending through said second cut and into said bore; the second ledge has a flat axial surface; and a second axial indentation on said outer surface of said inner cylindrical body, said second indentation having a flat axial surface that matches said flat axial surface of said second ledge, such that the first indentation and second indentation and first ledge and second ledge interact to prevent rotation of the inner housing in the bore.

8. An antirotational, mechanical lash controlling mechanism for two reciprocating bodies having opposing cylindrical surfaces comprising:

(a) an elongated outer housing having an outer surface and a cylindrical bore therein;

(b) a cylindrical inner housing positioned in said bore for reciprocal movement therein, said inner housing having an outer cylindrical surface;

(c) a radial U-shaped groove in the outer surface of the outer housing, said U-shaped groove having a first and second leg;

(d) a first radial cut in the first leg of said U-shaped groove, said cut extending from said groove into said bore;

(e) a U-shaped clip adapted to fit said U-shaped groove, said U-shaped clip having a first and second leg;

(f) a first ledge on said first leg of said U-shaped clip, said ledge extending through said first cut and into said bore;

(g) a first axial indentation on said outer cylindrical surface of said inner housing, said first indentation having a flat axial surface that matches said flat axial surface of said first ledge to prevent rotation of the inner housing in the bore; and (h) a first stop positioned at one axial end of said first indentation to control mechanical lash between the outer and inner housing.

9. The mechanism of claim 8 further comprising:

a second radial cut in the second leg of said U-shaped groove, said second cut extending from said groove into said bore; a second ledge on the second leg of said U-shaped clip, said second ledge extending through said second cut and into said bore; the second ledge has a flat axial surface and a second axial indentation on said outer surface of said inner cylindrical body, said second indentation having a flat axial surface that matches said flat axial surface of said second ledge, such that the first indentation and second indentation and first ledge and second ledge interact to prevent rotation of the inner housing in the bore; and a second stop positioned at one axial end of said second indentation to control mechanical lash between the outer and inner housing.

10. The mechanism of claim 8 further comprising a third stop position at the other end of said first indentation.

11. The mechanism of claim 9 further comprising a fourth stop at the other end of said second indentation.

12. The mechanism of claim 10 further comprising a fourth stop at the other end of said second indentation.

* * * * *